United States Patent [19]

Halcomb et al.

[11] Patent Number: 4,996,922

[45] Date of Patent: Mar. 5, 1991

[54] LOW PROFILE THERMITE IGNITER

[75] Inventors: Danny L. Halcomb, Camden; Jonathan H. Mohler, Spring Valley, both of Ohio

[73] Assignee: The United States of America as represented by the United States Department of Energy, Washington, D.C.

[21] Appl. No.: 436,573

[22] Filed: Nov. 15, 1989

[51] Int. Cl.[5] ..... F42C 19/08

[52] U.S. Cl. ..... 102/205; 102/275.6

[58] Field of Search ..... 102/275.4, 275., 5, 102/275.6, 205; 149/15

[56] References Cited

U.S. PATENT DOCUMENTS

| | | | |
|---|---|---|---|
| 2,953,443 | 9/1960 | Lloyd | 44/3 |
| 2,955,535 | 10/1960 | Show et al. | 149/15 |
| 2,999,460 | 9/1961 | Stinger et al. | 102/28 |
| 3,961,576 | 6/1976 | Montgomery | 102/491 |
| 3,961,579 | 6/1976 | Faber et al. | 102/90 |
| 4,013,061 | 3/1977 | Trumble et al. | 126/262 |
| 4,070,970 | 1/1978 | Scamaton | 102/202.4 |
| 4,216,721 | 8/1980 | Marziano et al. | 102/90 |
| 4,269,120 | 5/1981 | Brede et al. | 102/202 |
| 4,407,200 | 10/1983 | Bender et al. | 102/202.5 |
| 4,464,989 | 8/1984 | Gibson et al. | 102/202 |

FOREIGN PATENT DOCUMENTS

| | | | |
|---|---|---|---|
| 269619 | 11/1929 | Italy | 102/205 |

*Primary Examiner*—Charles T. Jordan
*Assistant Examiner*—Stephen Johnson
*Attorney, Agent, or Firm*—Armand McMillan; James H. Chafin; William R. Moser

[57] ABSTRACT

A thermite igniter/heat source comprising a housing, high-density thermite, and low-density thermite. The housing has a relatively low profile and can focus energy by means of a torch-like ejection of hot reaction products and is externally ignitable.

18 Claims, 1 Drawing Sheet

LOW PROFILE THERMITE IGNITERThe

Government has rights i this invention pursuant to Contract No. DE-AC04-76DP53 awarded by the U.S. Department of Energy to Monsanto Research Copr.

BACKGROUND OF THE INVENTION

1. Field of the Invention

The present invention generally relates to igniters or heat sources and, more particularly to an igniter/heat source having a relatively low profile.

2. Prior Art

Various types of igniters and heat sources are well known. In most prior art devices, there is a non-combustible portion of the igniter which is used to contain the combustible portion. Several such prior art devices are disclosed in U.S. Pat. Nos. 2,953,443; 2,999,460; 3,961,579; 4,013,061; 4,216,721; 4,407,200; 4,269,120. U.S. Pat. No. 4,464,989 discloses a thermite igniter/heat source comprising a container holding an internal igniter load wherein the container consists essentially of consumable consolidated thermite having a low gas output upon combustion, whereby upon ignition, substantially all of the container and the load are consumed with low gas production.

U.S. Pat. No. 3,961,579 discloses a thermite destructive device for melting volumes through metal items. The device includes a fuse which is dispersed through a lid which covers a top opening. The device includes a bottom member having an opening and an easily burnable cover. The outer casing remains intact throughout the burn cycle.

U.S. Pat. No. 4,407,200 discloses a detonator which includes an opening which is closed off with "the usual cover disks". The detonator includes two different explosives. A lacquer coating is disposed over the "firing side" of the detonator, the other side being closed off with a cap. The explosives can be packed into a cap member.

U.S. Pat. No. 2,953,443 discloses a chemical heating device comprising dense autogenous combustible material and slow-burning combustible material. The dense material is formed into an apex pointing toward the initial burning point. The slower-burning combustible material surrounds an ignition wire at the ignition point. The ends of the device are capped off with top and bottom plugs.

U.S. Pat. No. 4,216,721 discloses a thermite penetration device formed in the shape of a cone. The bottom of the device has a hole which permits the egress of reaction products.

U.S. Pat. No. 4,013,061 discloses a thermite heating device comprising a hermetically sealed cartridge containing alumino-thermic materials. The materials are formed with a cone-shaped depression adjacent to the percussion primer cap and the depression is filled with ignition materials.

It is an objective of the present invention to provide a new low-energy externally ignitable thermite igniter/-heat source e.g., for use in igniting larger charges such as propellant charges, or for use as a torch.

It is another objective of the present invention to provide a low-profile device which is externally ignitable that can focus the energy of a pyrotechnic reaction by means of a torch-like ejection of hot reaction products. Such ignition can be accomplished by virtually any heat source such as an electrical discharge through a hot wire, or another pyrotechnic reaction. This type of device is needed as a dependable, very compact heat source or ignition source for various purposes, such as for penetration of metallic or other solid objects and/or their destruction or obliteration.

SUMMARY OF THE INVENTION

The foregoing problems are overcome and other advantages are provided by an externally ignitable, low-profile thermite igniter/heat source.

In accordance with one embodiment of the present invention, a thermite igniter/heat source is provided having a housing, high-density thermite, and low-density thermite. The housing has a first portion having a bottom exit port, a relatively open top forming a center thermite receiving area, and having a relatively small height relative to the first portion width. The housing also comprises a second portion forming a top for the thermite receiving area. The housing also comprises means for passing a thermite igniter into the center thermite receiving area.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
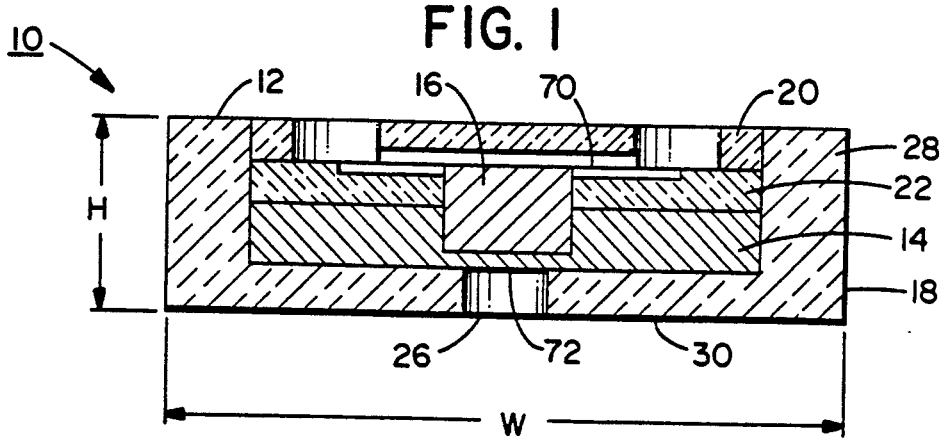
FIG. 1 is a cross-sectional view of a low-profile, externally ignitable pyrotechnic torch incorporating features of the present invention.
Figure 3:
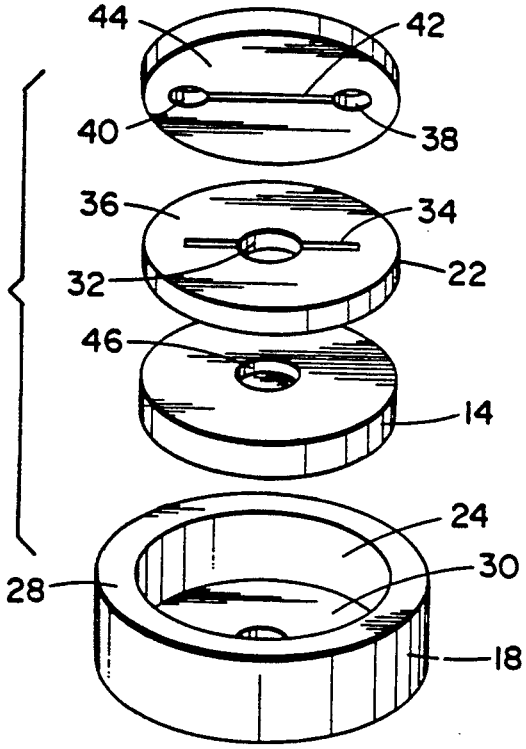
FIG. 3 is a partial exploded view of the torch shown in FIG. 1.

Referring to FIG. 1, there is shown a low profile externally ignitable pyrotechnic torch 10 incorporating features of the present invention. The torch is essentially self-supporting. In the embodiment shown, the torch 10 is generally comprised of a housing 12, a disk of high-density thermite 14 and low-density thermite powder 16. Thermite is a common name for the generic reaction between finely divided aluminum powder and a metal oxide such as iron oxide, copper oxide, tungsten oxide, or chromium oxide. The torch 10 has a small wafer-like shape. Referring also to FIG. 3, there is shown a partial exploded view of the torch 10 shown in FIG. 1. The housing 12, in the embodiment shown, is generally made of ceramic or other thermally insulative high temperature material. In the embodiment shown, the housing 12 generally comprises an outer housing 18, an outer top member 20, and an inner top member 22. The outer housing 18 generally has a relatively low profile with a relatively small height H relative to its width W. The outer housing 18 is generally disk-shaped with a center thermite receiving area 24 formed by sidewalls 28 and base 30. An exit port 26 extends through the base 30 from outside the outer housing 18 into the center thermite receiving area 24. The center thermite receiving area 24 is generally disk-shaped for cooperatingly receiving the high-density thermite disk 14. However, any suitable shape may be provided. The outer top member 20 and inner top member 22 are also generally disk-shaped and intended to be mounted in the center thermite receiving area 24 on top of the high-density thermite disk 14. The inner top member 22 generally comprises a center aperture 32 and a slot 34 on an upper surface 36. The outer top member 20, in the embodiment shown, generally comprises two apertures 38 and 40 passing therethrough with a slot 42 on a lower surface 44 communicating with the apertures 38 and 40.

The high-density thermite disk 14 generally comprises a center seat or cup 46 with a relatively small amount of thermite being located between the bottom of the center seat 46 and the bottom of the high-density thermite disk 14. With the torch assembled as shown in FIG. 1, the low-density thermite 16 is generally located in the center seat 46 and center aperture 32 of the inner top member 22. The two apertures 38 and 40 in the outer top member 20 and the two slots 34 and 42 cooperate to provide a path 70 for an igniter such as a wire or fuse to have access to and for heat ignition of the low-density thermite 16. This relatively narrow fuse passage 70 in combination with the high melting products of the thermite disk 14 and powder 16 in the relatively good heat-sinking material of the housing substantially prevents backfiring and causes hot reaction products to be ejected through the exit port 26 in the housing 12. Thus, even though external ignition is used, the fuse passage 70 nonetheless remains sealed. The center seat or cup 46 molded into the high-density thermite disk 14 generally serves two purposes; it provides a cavity for the low-density thermite starter material 16, and it makes a thin wall at the bottom of the center seat 46 in the high-density thermite disk 14 which constitutes a burnable barrier. This barrier 72 opens relatively early in the burn, initiating a high velocity torching process which exits the exit port 26. Ignition of the thin wall at the exit port causes the burn reaction to proceed backwards from the exit, giving an unrestricted torching path. Containment, exit and ignition mechanisms are all important interrelated features to produce an acceptable torch. Thus, the configuration, as shown in FIG. 1, makes it possible to contain a torch in a relatively low profile package.

Figure 2:
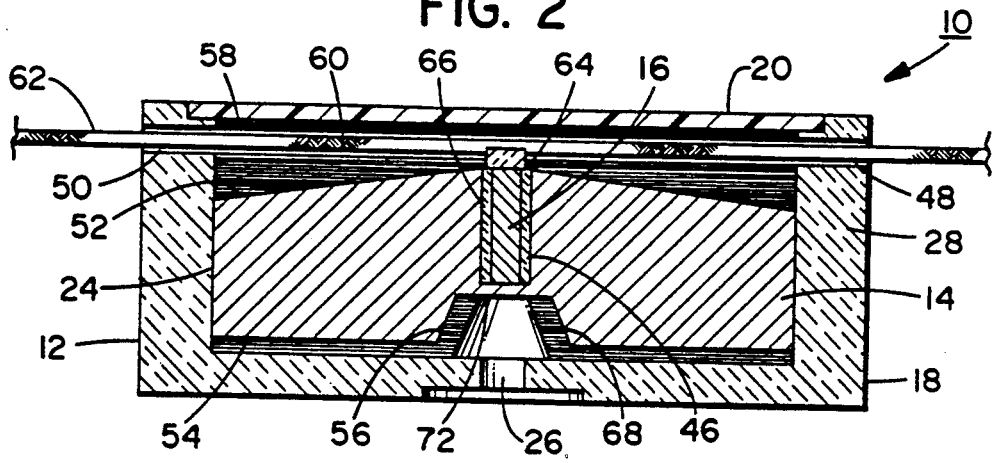
FIG. 2 is an alternate embodiment of the present invention.

Referring now to FIG. 2, there is shown an alternate embodiment of the present invention. In the embodiment shown, the outer housing 18 comprises two apertures 48 and 50 passing through the side wall 28 into the center thermite receiving area 24. The high-density thermite disk 14, in the embodiment shown, has a center seat or cup 46 pressed into the disk or pellet 14 to hold the low-density thermite ignition powder and to provide a thin-walled burnable barrier 72 proximate the exit port 26. The housing 12 has a single top member 20. Preferably, the top member 20 is electron beam welded to the outer housing 18. The disk 14, in the embodiment shown, has a general cone-shaped top side 52 with a relatively flat bottom side 54 having a central depression 56 proximate the center seat 46. An ignition disk 58 is generally provided between the top member 20 and the high-density thermite disk 14 which has a channel 60 alignable with the side apertures 48 and 50 to provide a path for a fuse 62 therethrough. Brass tubes (not shown may be inserted around fuse 62 in side apertures 48 and 50 in order to prevent pinching of the fuse. A second channel 64 is generally provided between the first channel 60 and the center seat 46 in the high-density thermite disk 14. In the embodiment shown, low-density thermite powder 16 is generally contained in a primer sleeve 66 in the high-density thermite disk center seat 46. In another embodiment, primer sleeve 66 and thermite powder column 16 are shortened in order to increase the distance between the bottom end of said sleeve and column and the top of nozzle 68. Prevention of back flow of hot material out of the back of the igniter is thereby rendered more effective. The torch 10 also comprises the nozzle 68 located between the bottom of the powder housing center thermite receiving area 24 and the bottom side 54 of the high-density thermite disk 14. The nozzle 68 is generally comprised of a material such as graphite and extends up into the central depression 56. The fuse 62 can ignite the low-density thermite powder which ignites the high-density thermite disk 14 with the thin wall 72 of the high-density thermite disk 14 proximate the nozzle 68 opening relatively early in the burn process and thus initiating the high-velocity torching process out the exit port 26. Ignition of the thin wall at the exit port causes the burn reaction to proceed backwards from the exit, giving an unrestricted torching path. In the embodiment shown in FIG. 2, the torch 10 has an outer diameter of about 0.75 inch and a height of about 0.30 inch. The relatively narrow fuse channel through the ignition disk 58 can generally prevent any backflow of the burning process. Thus, the present invention allows for a pyrotechnic torch which is structured to permit external ignition, has a relatively low profile for ready miniaturization, and is comprised of materials which are all stable at high ambient temperatures. The present invention thus provides a dependable, very compact heat source or ignition source for various purposes, such as for penetration of metallic or other solid objects and/or their destruction or obliteration.

It should be understood that the foregoing description is only illustrative of the invention. Various alternatives and modifications can be devised by those skilled in the art without departing from the spirit of the invention. Accordingly, the present invention is intended to embrace all such alternatives, modifications, and variances which fall within the scope of the appended claims.

What is claimed is:

1. A thermite igniter/heat source comprising:

a housing being comprised of a thermally insulative material capable of withstanding relatively high temperatures, said housing comprising a first portion having a bottom exit port, a relatively open top forming a center thermite receiving area, and having a relatively low profile with a relatively small height relative to its width, said housing further comprising a second portion forming a top for said thermite receiving area, said housing having means for passing a fuse into said center thermite receiving area;

high-density thermite located in said thermite receiving area; and low-density thermite located in said thermite receiving area between an outer top member and said high-density thermite such that a fuse passing into said passing means can ignite said low-density thermite which in turn can ignite said high-density thermite and can exit heat from said exit port with a torch-like ejection of hot reaction products.

2. A thermite igniter/heat source as in claim 1 wherein said housing second portion comprises an outer top member and an inner top member.

3. A thermite igniter/heat source as in claim 2 wherein said outer top member has two spaced holes passing therethrough.

4. A thermite igniter/heat source as in claim 3 wherein said outer top member has a groove on one side thereof between said holes.

5. A thermite igniter/heat source as in claim 2 wherein said inner top member comprises an aperture therethrough for at least partially positioning said low-density thermite therein.

6. A thermite igniter/heat source as in claim 5 wherein said inner top member has a groove on one side thereof communicating with said aperture.

7. A thermite igniter/heat source as in claim 1 wherein said housing has a disk-like profile.

8. A thermite igniter/heat source as in claim 1 wherein said means for passage of a fuse through said receiving area comprise apertures.

9. A thermite igniter/heat source as in claim 1 wherein said housing second portion has a first aperture therethrough for passage of a fuse and a second aperture intersecting said first aperture for receiving at least a portion of said low-density thermite.

10. A thermite igniter/heat source as in claim 1 wherein said low-density thermite extends into said high-density thermite such that a relatively thin height of high-density thermite is located between said low-density thermite and said exit port.

11. A thermite igniter/heat source as in claim 1 wherein said high-density thermite is shaped as a pellet.

12. A thermite igniter/heat source as in claim 11 wherein said pellet is disk-shaped.

13. A thermite igniter/heat source as in claim 12 wherein said pellet comprises a center cup for receiving at least a portion of said low-density thermite.

14. A thermite igniter/heat source as in claim 1 wherein said low-density thermite is at least partially contained in a primer sleeve.

15. A thermite igniter/heat source as in claim 1 further comprising means for preventing backfiring.

16. A thermite igniter/heat source as in claim 1 further comprising a nozzle between said high-density thermite and said exit port.

17. A thermite igniter/heat source as in claim 11 wherein said pellet has a crowned top side and a relatively flat bottom side.

18. A thermite igniter/heat source as in claim 1 wherein said housing first portion is welded to said housing second portion.

* * * * *